US005917185A

United States Patent [19]

Yeung et al.

[11] Patent Number: 5,917,185

[45] Date of Patent: Jun. 29, 1999

[54] LASER VAPORIZATION/IONIZATION INTERFACE FOR COUPLING MICROSCALE SEPARATION TECHNIQUES WITH MASS SPECTROMETRY

[75] Inventors: Edward S. Yeung, Ames, Iowa; Yu-chen Chang, Taichung Hsien, Taiwan

[73] Assignee: Iowa State University Research Foundation, Inc., Ames, Iowa

[21] Appl. No.: 08/882,855

[22] Filed: Jun. 26, 1997

[51] Int. Cl.[6] ..... H01J 49/04

[52] U.S. Cl. ..... 250/288; 250/423 P

[58] Field of Search ..... 250/288, 288 A, 250/423 P

[56] References Cited

U.S. PATENT DOCUMENTS

| | | | |
|---|---|---|---|
| 4,794,253 | 12/1988 | Kobayashi | 250/288 |
| 4,885,076 | 12/1989 | Smith et al. | 250/288 |
| 5,118,937 | 6/1992 | Hillenkamp et al. | 250/288 |
| 5,171,989 | 12/1992 | Williams et al. | 250/288 |

OTHER PUBLICATIONS

A.T. Blades et al., "Mechanism of Electrospray Mass Spectrometry. Electrospray as an Electrolysis Cell", *Anal. Chem.*, 63, pp. 2109–2114 (1991).

R.M. Caprioli et al., "Continuous–Flow Sample Probe for Fast Atom Bombardment Mass Spectrometry", *Anal. Chem.*, 58, pp. 2949–2954 (1986).

R.M. Caprioli et al., "Coupling Capillary Zone Electrophoresis and Continuous–Flow Fast Atom Bombardment Mass Spectrometry for the Analysis of Peptide Mixtures", *Journal of Chromatography*, 480, pp. 247–257 (1989).

S.Y. Chang et al., "Laser Vaporization/Ionization Interface for Capillary Electrophoresis—Time–of–Flight Mass Spectrometry", *Advance ACS Abstracts,* 5, p. 1 (1997).

Z. Deyl et al., "Capillary zone electrophoresis: its applicability and potential in biochemical analysis", *Journal of Chromatography,* 569, pp. 63–122 (1991).

A.G. Ewing et al., "Capillary Electrophoresis", *Anal. Chem.,* 61, pp. 292a–303a (1989).

L. Fang et al., "On–Line Time–of–Flight Mass Spectrometric Analysis of Peptides Separated by Capillary Electrophoresis", *Anal. Chem.*, 66, pp. 3696–3701 (1994).

X. Fei et al., "Aerosol MALDI with a Reflection Time–of–Flight Mass Spectrometer", *Anal. Chem.*, 68, pp. 1143–1147 (1996).

J.D. Henion et al., "Quantitative Capillary Electrophoresis–Ion Spray Mass Spectrometry on a Benchtop Ion Trap for the Determination of Isoquinoline Alkaloids", *Anal. Chem.*, 66, pp. 2103–2109 (1994).

S.A. Hofstadler et al., "On–Line Capillary Electrophoresis with Fourier Transform Ion Cyclotron Resonance Mass Spectrometry", *J. Am. Chem. Soc.*, 115, pp. 6983–6984 (1993).

E.C. Huang et al., "Atmospheric Pressure Ionization Mass Spectrometry: Detection of the Separation Sciences", *Anal. Chem.*, 62, pp. 713A–725A (1990).

W.G. Kuhr, "Capillary Electrophoresis", *Anal. Chem.,* 62, pp. 403 r–414 r (1990).

(List continued on next page.)

*Primary Examiner*—Jack I. Berman
*Attorney, Agent, or Firm*—Mueting, Raasch & Gebhardt, P.A.

[57] ABSTRACT

The present invention provides a laser-induced vaporization and ionization interface for directly coupling microscale separation processes to a mass spectrometer. Vaporization and ionization of the separated analytes are facilitated by the addition of a light-absorbing component to the separation buffer or solvent.

76 Claims, 8 Drawing Sheets

OTHER PUBLICATIONS

W.G. Kuhr et al., "Capillary Electrophoresis", *Anal. Chem.*, 64, pp. 389R–470R (1992).

L. Li et al, "Continuous–Flow Matrix–Assisted Laser Desorption Ionization Mass Spectrometry", *Anal. Chem.*, 65, pp. 493–495 (1993).

M.A. Moseley et al., "Capillary zone electrophoresis–mass spectrometry using a coaxial continuous–flow fast atom bombardment interface", *Journal of Chromatography,* 516, pp. 167–173 (1990).

K.K. Murray et al., "Liquid Sample Introduction for Matrix–Assisted Laser Desorption Ionization", *Anal. Chem.*, 65, pp. 2534–2537 (1993).

D.S. Nagra et al., "Liquid chromatography–time–of–flight mass spectrometry with continuous–flow matrix–assisted laser desorption ionization", *Journal of Chromatography A,* 711, pp. 235–245 (1995).

J.A. Olivares et al., "On–Line Mass Spectrometric Detection for Capillary Zone Electrophoresis", *Anal. Chem.*, 59, pp. 1230–1232 (1987).

N.J. Reinhoud et al., "Performace of a Liquid–junction Interface for Capillary Electrophoresis Mass Spectrometry Using Continuous–flow Fast–atom Bombardment", *Rapid Communications in Mass Spectrometry,* 3, pp. 348–351 (1989).

C. Schwer et al., "Capillary Electrophoresis", *Chromatographia,* 30, pp. 546–554 (1990).

M. Yamashita et al., "Electrospray Ion Source. Another Variation on the Free–Jet Theme", *J. Phys. Chem.*, 88, pp. 4451–4459 (1984).

A.P.L. Wang et al., "Liquid Chromotography/Time–of–Flight Mass Spectrometry with a Pulsed Sample Introduction Interface", *Anal. Chem.*, 66, pp. 3664–3675 (1994).

A.P.L. Wang et al., "Pulsed Sample Introduction Interface for Combining Flow Injection Analysis with Multiphoton Ionization Time–of–Flight Mass Spectrometry", *Anal. Chem.*, 64, pp. 769–775 (1992).

LASER VAPORIZATION/IONIZATION INTERFACE FOR COUPLING MICROSCALE SEPARATION TECHNIQUES WITH MASS SPECTROMETRY

STATEMENT OF GOVERNMENT RIGHTS

This invention was made with government support under grants from the United States Department of Energy (Contract No. W-7405-Eng-82). The U.S. government has certain rights in this invention.

BACKGROUND OF THE INVENTION

Capillary electrophoresis (CE) is a microscale separation technique which has a number of practical advantages over conventional separation methods. Among them are high separation efficiency, high speed, and small sample size. However, the small sample size used in CE puts a high demand on detector sensitivity.

A mass spectrometer (MS) is a universal detector. It can provide information regarding molecular masses or the structure of compounds with high sensitivity. The first on-line CE-MS was demonstrated by Smith and co-workers in 1987 (J. A. Olivares et al., *Anal Chem.* 1987, 59, 1230–1232). In on-line CE-MS, the CE eluate is introduced directly into a mass spectrometer. Analytes are distinguished not only by their migration times but also by their molecular masses or fragmentation pattern. CE-MS is thus very useful in the analysis of small, complex samples, and is especially well-suited for analysis of biological materials.

CE has been coupled with many types of mass spectrometers. The ion utilization efficiency in quadrupole MS for full-scan spectra is low. CE is thus preferably coupled with mass spectrometers having higher ion utilization efficiency such as Fourier transform ion cyclotron resonance mass spectrometers (S. A. Hofstadler et al., *J. Am. Chem. Soc.* 1993, 115, 6983–6984), ion-trap mass spectrometers (J. Henion et al., *Anal. Chem.* 1994, 66, 2103–2109), and time-of-flight mass spectrometers (L. Fang et al., *Anal. Chem.* 1994, 66, 3696–3701). Since TOF-MS has high transmission efficiency and can tolerate relatively high background pressures, it may provide the best sensitivity achievable with the current alternatives. Complete mass spectra can be recorded in a single event. Up to 100000 mass spectra can be produced in a second. The high speed of TOF-MS is suitable for the detection of analytes separated by CE, since the duration of the peaks in CE separation is only several seconds. Also, in principle, an unlimited mass range can be achieved, which is suitable for the study of large biomolecules.

Currently, the major challenge in CE-MS is the development of interfaces for introducing the liquid flow into the mass spectrometer without significant loss in the performance of either CE or MS. CE is typically coupled to MS using electrospray ionization (ESI) (M. Yamshita et al., *J. Phys. Chem.* 1984, 88, 4451–4459; E. C. Huang et al., *Anal. Chem.* 1990, 62, 713A–725A; A. T. Blades et al., *Anal. Chem.* 1991, 63, 2109–2114) or continuos-flow fast-atom bombardment (CE-FAB) (R. M. Caprioli et al., *Anal. Chem.* 1986, 58, 2949–2954; M. A. Moseley et al., *J. Chromatogr.* 1990, 516, 167–173; R. M. Caprioli et al., *J Chromatogr.* 1989, 480, 247–257; N. J. Reinhoud et al., *Rapid Commun. Mass Spectrom.* 1989, 3, 348–351.). MS generates structural information by ascertaining mass to charge ratios for the various ionic species produced by fragmentation of the analyte of interest. Typically, these ionic species have a single charge due to their association with a proton ($H^+$).

Since electrospray produces multiply-charged molecular species, ESI permits characterization of analytes having molecular weights significantly higher than the upper mass limit of the spectrometer. However, because ESI must be performed at atmospheric pressure, only a fraction of the ions produced is skimmed into the MS, sharply reducing the efficiency of the detection.

Recently, several other interfaces have been developed for coupling separation techniques with MS. These include a pulsed sample introduction interface (A. Wang et al., *Anal. Chem.* 1992, 64, 769–775; A. Wang et al., *Anal. Chem.* 1994, 66, 3664–3675), a continuous-flow matrix-assisted laser desorption/ionization (MALDI) interface (L. Li et al., *Anal. Chem.* 1993, 65, 493–495; D. A. Nagra et al., *J. Chromatogr.* A 1995, 711, 235–245), and an aerosol MALDI interface (K. K. Murray et al., *Anal. Chem.* 1993, 63, 2534–2537; X. Fei et al., *Anal. Chem.* 1996, 68, 1143–1147). These new interfaces show good potential to couple CE with MS; however, a make-up solvent is usually required. A make-up solvent is used to increase the total flow rate into the system, for example, to support droplet formation. Supplying a make-up solvent necessitates introduction of a large amount of electrolyte, diluting the concentration of the analyte. In addition, the added electrolytes contribute to chemical noise. The detection limit of proteins in CE-MS is typically in the high femtomole range. However, the concentration limit of detection is in the range of $10^{-6}$M. This is not sufficient for the study of many biological samples. In order to improve detection limits, new interfaces with high ionization efficiency and high sample utilization are needed.

SUMMARY OF THE INVENTION

The present invention provides a new interface for coupling microscale separation protocols with mass spectrometers. The novel interface permits direct introduction of the eluate from a microscale separation process, such as capillary electrophoresis (CE), into a mass spectrometer (MS), preferably a time-of-flight mass spectrometer (TOF-MS), for structural analysis. A laser is used to vaporize and ionize the solution directly from the capillary. Laser vaporization and ionization (LVI) is accomplished by the addition to the running buffer of a matrix material (a light-absorbing solute), which serves as a laser energy absorber at the interface and, optionally in the case of electrophoretic separations, acts as an electrolyte as well. At the capillary outlet, all of the eluate is vaporized, and analyte ions are extracted, for example into a TOF flight tube, without loss.

The present invention thus provides an interface for coupling a microscale analyte separation apparatus to a mass spectrometer formed by a capillary comprising an outlet end for delivery of a liquid comprising an analyte to the internal evacuated chamber of the mass spectrometer, wherein the outlet end of the capillary is located in the evacuated internal chamber of the mass spectrometer. Optionally, the device can include the mass spectrometer or the microscale separation apparatus, or both. A laser, preferably a pulsed laser, for irradiation of the eluate at the outlet end of the capillary inside the mass spectrometer is also optionally included in the device.

In a preferred embodiment, the invention provides an device for coupling a capillary electrophoresis apparatus to a mass spectrometer, comprising a mass spectrometer comprising an evacuated internal chamber; a capillary comprising an outlet end for delivery of a liquid comprising an analyte to the mass spectrometer, wherein the outlet end is located in the evacuated internal chamber of the mass spectrometer; and an electrical conductor for conducting electrical current during electrophoresis, electrically connected to the outlet end of the capillary. Preferably the electrical conductor is a metal wire inserted into the outlet end of the capillary.

Also provided by the present invention is a method for structural characterization of an analyte by introducing a liquid comprising an analyte and a light-absorbing solute into the evacuated internal chamber of a mass spectrometer; irradiating the liquid to cause vaporization and ionization of the analyte; and analyzing the vaporized ionized analyte using mass spectrometry. In a preferred method, prior to introduction into the mass spectrometer the analyte is subjected to a microscale separation process using an apparatus coupled to the mass spectrometer. For example, the invention provides a method for structural characterization of a separated analyte comprising:

(a) introducing a sample comprising at least one analyte into a capillary containing a liquid buffer or solvent, wherein the buffer or solvent comprises a light-absorbing solute;

(b) separating the at least one analyte from the sample to yield an eluate comprising the separated analyte and the light-absorbing solute;

(c) eluting the eluate from the outlet end of a capillary, wherein the outlet end is located in the evacuated internal chamber of a mass spectrometer;

(d) irradiating the eluate with a laser during elution from the outlet end of the capillary to cause vaporization and ionization of the separated analyte; and (e) analyzing the vaporized ionized separated analyte using mass spectrometry.

The buffer solution used in the present invention can, but need not, be entirely aqueous. The vaporization/ionization process is based on the efficient and controlled laser energy transfer to the liquid, made possible by the inclusion of the light-absorbing solute in the running buffer. There is no need to supply a make-up solvent or gas to help the vaporization/ionization process because the interface does not require any additional flow of material into the MS ionization region; therefore, the instrumentation is simplified. Optimal performance can be achieved by balancing the capillary solution flow rate and the laser-induced vaporization and ionization rate.

DETAILED DESCRIPTION OF THE INVENTION

Figure 1:
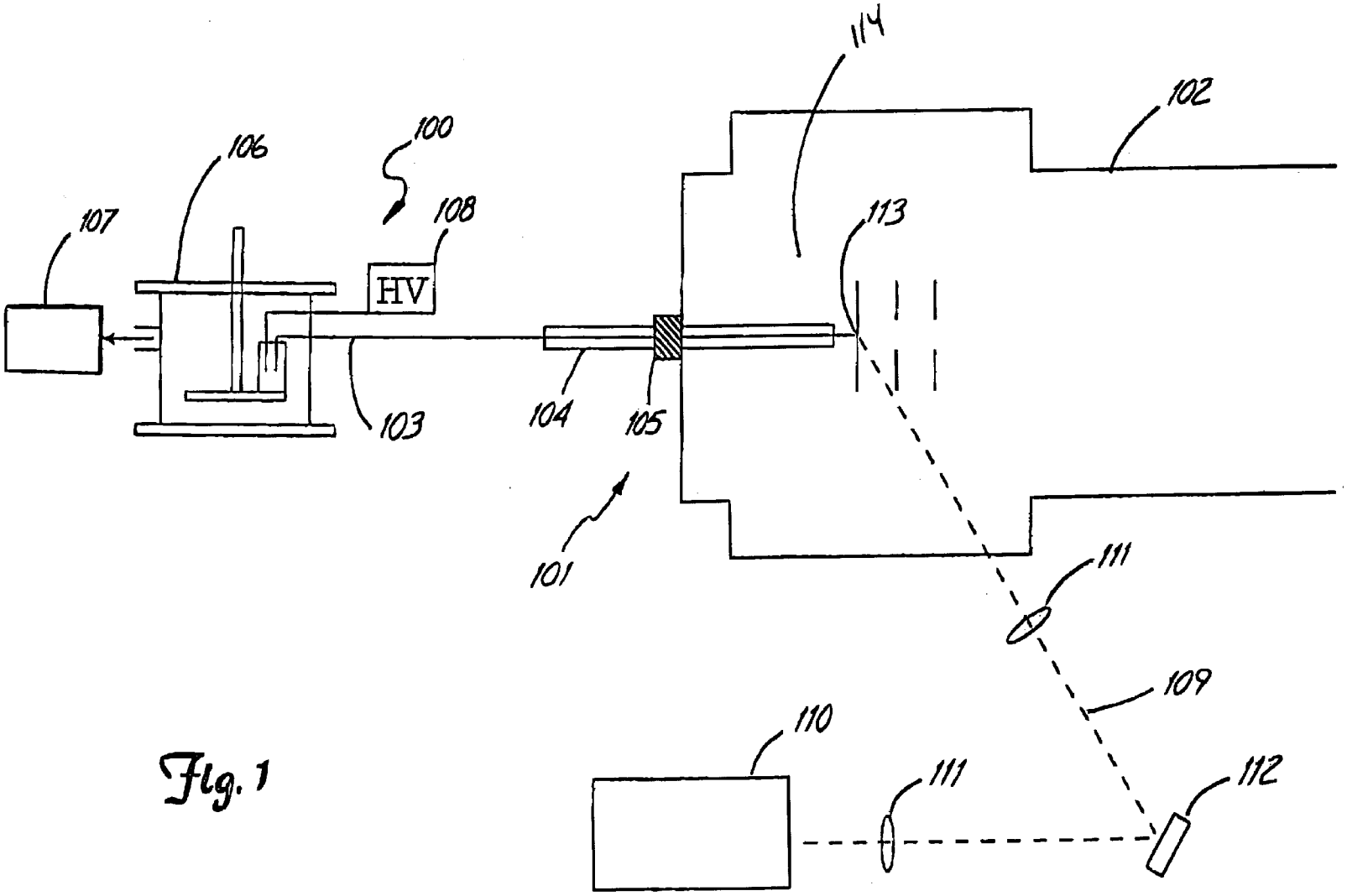
FIG. 1 is a schematic diagram of a capillary electrophoresis laser vaporization/ionization time-of-flight mass spectrometer (CE-LVI-TOF-MS).

The present invention provides a laser-induced vaporization and ionization (LVI) interface that allows direct introduction of a liquid phase analyte into a mass spectrometer (MS). The outlet end of a capillary is positioned such that it is capable of delivering a liquid eluate containing a separated analyte and a light-absorbing solute directly to the evacuated internal chamber of the mass spectrometer. A laser can then be used to irradiate the eluate and cause vaporization and ionization of the analyte inside the mass spectrometer as it elutes from the outlet end of the capillary.

The present invention is particularly useful for coupling a capillary-based microscale separation technique to a mass spectrometer. Any microscale separation apparatus can be coupled to a MS using the LVI interface of the invention, such as a capillary electrophoresis (CE) apparatus, capillary electrochromatography (CEC) apparatus, liquid chromatography (LC) apparatus, such as high performance liquid chromatography (HPLC), or the like. The present invention thus further provides an analyte separation and detection system that includes a mass spectrometer coupled to a microscale analyte separation apparatus using the laser-induced vaporization and ionization interface.

Mass spectrometry is conducted in a near vacuum. For example, the internal chamber of a TOF-MS is typically evacuated to a pressure of below about $10^{-6}$ torr, preferably about $4\times10^{-7}$ torr prior to conducting an experiment. As a result, conventional interfaces used to couple liquid microscale separation systems with mass spectrometry universally contemplate the elution of analytes outside the spectrometer, eventually introducing only a portion of the analytes to the MS. Placement of the capillary tip (i.e., the outlet end) inside the evacuated internal chamber of the MS according to the present invention allows delivery of the entire eluted material from the capillary into the MS, resulting in much more efficient sample utilization.

Mass spectrometric analysis requires a gas-phase, ionized analyte. In the present invention, however, the analytes eluting from the capillary are in liquid phase or liquid solution; they still need to be vaporized and ionized before becoming amenable to mass spectrometeric analysis. The present invention utilizes a laser to irradiate the eluate at the capillary tip, but typically the eluting analytes are not themselves capable of absorbing a sufficient amount of energy to vaporize and ionize. Thus, the present invention further contemplates co-elution of a light-absorbing solute to absorb and transfer a sufficient amount of laser energy so as to cause vaporization and ionization of the analyte of interest.

Coupling of the capillary to the mass spectrometer. The present invention is not limited by the composition, length or internal diameter of the capillary; generally, any capillary suitable for use in the separation system to be coupled to the mass spectrometer can be used in the laser vaporization/ionization. Typically, a fused silica capillary is used. The fused silica capillary may be either coated or uncoated. The internal diameter of the capillary typically does not exceed about 100 $\mu$m, preferably about 75 $\mu$m, more preferably about 60 $\mu$m. Preferably the capillary internal diameter is greater than about 10 μm, more preferably greater than about 25 μm, most preferably greater than about 40 μm.

The capillary is inserted into the internal chamber of the mass spectrometer such that the capillary outlet is preferably positioned at the center of the back plate. The portion of the capillary that penetrates the MS wall is stabilized by encasing it in, for example, a glass rod. Stabilizing the capillary insures that the outlet end is fixed in position inside the mass spectrometer. The junction of the capillary and the MS wall is vacuum sealed using a standard vacuum-sealed feed-through or other suitable vacuum joint. Such seals well-known in the art of mass spectroscopy. The vacuum seal can take any suitable form, such as an O-ring, a gasket, a "K"-joint, vacuum grease, and the like, or any combination thereof.

Laser geometry. The LVI interface of the invention utilizes a laser to vaporize the capillary eluate and ionize the analytes of interest. Pulsed lasers are preferred over continuous wave lasers because they are generally capable of transferring more laser energy to the eluate. For example, a waveguide excimer laser is a small, convenient, readily available pulsed laser suitable for use in the invention. Preferably, the laser is a UV laser with a pulse rate of about 10 Hz to about 1000 Hz. The laser and light-absorbing solute are chosen such that the wavelength of the light emitted by the laser is a wavelength that is absorbed by the light-absorbing solute.

The laser is positioned outside the mass spectrometer, and the output beam is directed through a transparent wall of the mass spectrometer or a transparent window in the MS wall. Alternatively, a laser capable of performing in a vacuum can, if desired, be positioned in the evacuated internal chamber of the mass spectrometer. Typically, the output beam from the laser is collimated by a lens, then deflected into the MS chamber through the transparent wall by a mirror. A second lens is optionally used to further focus the laser beam after deflection by the mirror. In contrast to conventional CE-MS systems, the present invention allows formation of the ions within the mass spectrometer. The laser is positioned so that the focal point of the beam is coincident with the outlet end of the capillary, and the beam waist is about 10 μm to about 50 μm, preferably about 20 μm to about 30 μm. The laser irradiates the capillary at an angle, between about 0° and about 80°, with respect to the TOF axis.

Alternatively, laser energy can be transmitted to the eluate eluting at the outlet end of the capillary by using optical fibers. When optical fibers are used, they can be brought into contact with the outlet end of the capillary by inserting them through the wall of the mass spectrometer. The joint is then sealed using a standard vacuum-sealed feed-through.

Upon irradiation of the eluted analyte, analyte ions are formed at the mass spectrometer repeller and are immediately extracted into the TOF flight tube. Preferably, the laser operates at a repetition rate of 200 to 1000 Hz to continuously vaporize the solution at the outlet end of the capillary.

Light-absorbing solute. The eluate from the capillary contains a compound that absorbs laser energy, causing vaporization of the eluate components into the gas phase and ionization of the analytes of interest. Low molecular weight solutes are preferable for use as light-absorbing solutes because they are less likely to obscure the MS data for the analyte fragments. For higher molecular weight analytes, however, correspondingly higher molecular weight compounds, such as serotonin or aniline, can be used as absorbing solutes. Suitable absorbing additives do not adversely affect or interfere with the separation process, and are capable of dissolving in water. For example, rare earth ions typically are soluble and absorb light, making them good candidates for absorbing solutes. Similarly, any organic solute with a benzene ring will absorb UV light and will be a candidate for use as the light-absorbing additive. When the LVI interface is used to couple an electrophoretic separation technique to mass spectrometry, the light-absorbing solute of the matrix also preferably functions as the buffer electrolyte.

A preferred light-absorbing solute is copper (II) chloride ($CuCl_2$). $CuCl_2$ is water soluble, low molecular weight and, advantageously, can also serve as the buffer electrolyte in electrophoretic separations. For example, a running buffer containing about 0.05 mM to about 1.0 mM $CuCl_2$ in water can be used for CE separations. Serotonin has strong absorption at 248 nm, and can advantageously be used as the absorbing solute for larger molecular weight analytes yielding a MS fragmentation pattern substantially comprising fragments of higher molecular weight than serotonin. Aniline is another suitable small molecular weight solute that absorbs laser light.

The light-absorbing solute is typically and preferably supplied as a component of the separation buffer and thus continuously present at the capillary outlet. Alternatively, it can be mixed with the analytes eluting at the outlet end of the capillary at a liquid junction just upstream from or at the capillary tip. It is also possible to introduce into the capillary a pulse of the light-absorbing solute concurrent with the introduction of the sample, provided the analyte of interest and the light-absorbing solute co-elute from outlet end of the capillary inside the mass spectrometer.

Flow control. Placement of the capillary outlet end in the evacuated MS chamber generates a strong, vacuum-induced flow in the capillary due to the pressure differential. The magnitude of this vacuum-induced flow depends on the internal diameter of the capillary and its length. In order to modulate hydrodynamic flow, the samples can optionally be placed in a sample box which is evacuated by a mechanical pump to a pressure that yields the desired flow rate. For electrophoretic separations, for example, it is convenient to evacuate the sample chamber to about 50 torr to about 100 torr. The residual flow of about 2 nanoliters to about 3 nanoliters per second is comparable to typical bulk flow rate of conventional CE. The sampling region can be automated to allow straightforward injection and manipulation under vacuum. Generally, the lower the vacuum-induced flow rate, the narrower (more resolved) the analyte bands become. In principle, the vacuum-induced flow can be reduced to zero if desired.

Stable operation of the laser vaporization/ionization interface is achieved by balancing the rate of laser vaporization and the solution flow rate. The rate of laser vaporization is determined by the laser energy, pulse rate, and nature of the light-absorbing solute used to transfer the laser energy to the analyte of interest. The solution flow rate is a combination of vacuum-induced flow, pressure-induced (hydrostatic) flow, and/or electroosmotic flow, depending on the application and the separation protocol used. If the solution flows faster than the rate of laser vaporization, ice forms at the tip of the capillary to block the flow. However, if the solution flows slower than the rate of vaporization, intermittent signals are produced and the pulse-to-pulse reproducibility of the mass spectra is poor. One of skill in the art can readily identify the combination of laser energy, pulse rate, light-absorbing solute, and solution flow rate best suited for a given application.

Mass spectrometer. The LVI interface can be utilized with any mass spectrometer. Preferably, the LVI interface is coupled with a mass spectrometer having higher ion utilization efficiency such as a Fourier transform ion cyclotron resonance mass spectrometer, an ion-trap mass spectrometer, or a time-of-flight mass spectrometer (TOF-MS). Preferably, ion detection is accomplished using a linear time-of-flight mass spectrometer; the laser vaporization/ionization interface of the invention preferably provides a pulsed ion source, which is especially amenable to time-of-flight mass analysis.

The present invention provides results superior to that achieved using conventional ESI-MS; mass spectra produced by the LVI interface contain not only parent ions (like ESI) but also some fragment ions, thus providing structural information. The ability to obtain mass spectra at about 100 Hz utilizing the present invention opens up the possibility of coupling the LVI-MS interface to fast CE or after separation on microchips.

CE-LVI-MS. In a preferred embodiment of the invention, the LVI interface directly couples a capillary electrophoresis (CE) apparatus to a mass spectrometer. Any viable CE separation protocol, such as capillary gel electrophoresis (CGE) or capillary zone electrophoresis (CZE) can be coupled to a mass spectrometer using the present LVI interface. In a conventional CE system, the cathodic end (outlet end) of the capillary is placed in a vial containing an electrolyte solution. But because the outlet end (cathodic end) of the capillary in the present invention is in a vacuum environment, the electrical circuit cannot be completed by simply contacting the outlet end of the capillary with a liquid buffer vial in the conventional manner. Nevertheless, it remains necessary to generate a voltage drop across the capillary in order to complete the CE circuit and to extract ions into the MS.

The requisite electrical connection can be made according to the present invention in any number of ways. Preferably, a metal wire is inserted into the outlet end of the capillary such that the wire is in electrical contact with the solution inside the capillary. The metal wire is preferably fabricated from gold, platinum, or tungsten. Optionally, the wire can be protectively coated to prevent oxidation, erosion or dissolution caused by direct contact with the buffer, as long as electrical conductivity is maintained. For example, the wire can be dipped into a solution of 0.3 g cellulose acetate in 1.5 ml acetone to produce a thin, protective, conductive coating. The wire is threaded through the MS wall in a standard vacuum-sealed feed-through.

As an alternative to the metal wire, the electrical circuit can be completed using a liquid junction that remains isolated from the vacuum inside the mass spectrometer. This can be accomplished using a connector or valve, such as a T-type or crosswise type connector, immediately preceding or adjacent to the outlet end of the capillary. A conductive liquid can thereby be placed in contact with the capillary eluate by, for example, connecting the CE capillary with one or more capillaries or delivery tubes that extend outside the mass spectrometer. The points in the mass spectrometer wall through which these capillaries or delivery tubes pass are vacuum sealed. Another alternative for providing the requisite electrical contact is the use of a packed salt bridge. The capillary eluate is brought into contact with the salt bridge inside the mass spectrometer, just upstream from or adjacent to the outlet end. The salt bridge extends through the wall of the mass spectrometer (vacuum sealed) and completes the electrical circuit outside the mass spectrometer.

Samples can be introduced into the capillary in any convenient manner, for example by using hydrostatic (pressure) injection or electrokinetic injection.

FIG. 1 shows a schematic diagram of an embodiment of the CE-LVI-TOF-MS apparatus of the invention. The apparatus combines a capillary electrophoresis (CE) system 100, the laser vaporization/ionization (LVI) interface of the invention 101, and a time-of-flight mass spectrometer (TOF-MS) 102. The physical interface between the capillary 103 and the TOF-MS 102 is formed using a glass rod 104 to stabilize the capillary 103, and a vacuum fitting 105. The inside of the TOF-MS 102 is evacuated to the required vacuum, typically a pressure of about $4\times10^{-7}$ torr, which increases slightly when the sample is introduced. The sample is introduced into the capillary 103 from the sample box 106, which is evacuated with a vacuum pump 107 to a pressure of about 50 torr to about 100 torr to prevent uncontrolled suction of the capillary contents into the TOF-MS 102. Electrophoresis is effected with a high voltage power supply 108. The excitation beam 109 from an excimer laser 110 is focused and directed with the aid of lenses 111 and a mirror 112 through the wall of the TOF-MS 102 so as to contact the separated analytes as they elute from the outlet end 113 of the capillary 103 inside the evacuated internal chamber 114 of TOF-MS 102.

Advantages of the invention are illustrated by the following examples. However, the particular materials and amounts thereof recited in these examples, as well as other conditions and details, are to be interpreted to apply broadly in the art and should not be construed to unduly limit the invention.

EXAMPLE

CE-LVI-TOF-MS Characterization of Selected Catecholamines and Peptides

I. Materials and Methods.

Capillary electrophoresis. The length of the fused-silica capillary (with 50 to 75 $\mu$m i.d. and 360 $\mu$m o.d.) was 45 cm (Polymicro Technology Inc., Phoenix, Ariz.). $CuCl_2$ was used as the light-absorbing solute. The CE running buffer was 0.05 to 1.0 mM $CuCl_2$ in water without additional pH adjustment. The measured pH of the solution was approximately pH 5. 10 kV is applied across the capillary by supplying 14.1 kV to the anode and 4.1 kV to the cathode via separate power supplies. The samples were put in a sample box which was evacuated by a mechanical pump to a pressure of 50–100 torr. This way, the residual flow was 2–3 nl/second, which is comparable to typical bulk flow rate of regular CE.

A 15-$\mu$m tungsten wire (Johnson Matthey, Ward Hill, Mass.) was inserted approximately 1 to 2 mm into the end of the CE capillary to establish electrical contact. A voltage of 4.1 kV was then applied to the solution to complete the CE circuit and to extract ions into the MS. In some experiments, before insertion, the tungsten wire was dipped into a solution of 0.3 g cellulose acetate in 1.5 ml acetone to produce a thin coating. Samples were injected into the capillary using a 5 to 15 second hydrodynamic flow. The separation current was 170 nA for 0.05 mM $CuCl_2$. The peptides were obtained from Sigma (St. Louis, Mo.) and catecholamines were obtained from Aldrich (Milwaukee, Wis.). The flow rate used (2.5 nl/sec) is similar to the flow rate of regular CE. All samples are dissolved in buffer and then diluted to the desired concentrations.

Laser vaporization/ionization interface. A waveguide excimer laser (Model GX-1000, Potomac Photonic Inc., Lanham, Md.) was used to vaporize and ionize the eluate from CE. The 248-nm output provides a maximum energy of 60 $\mu$J per pulse with a pulse width of 50 ns. The output beam from the laser was collimated by a 120 cm focal length lens, then deflected into the MS chamber by a mirror. A 25 cm focal length lens was used to further focus the laser beam. The focal point of the laser was right at the end of the capillary, and the beam waist was about 25 $\mu$m. The laser energy measured in front of the capillary was 34 $\mu$J, which corresponds to a power density of $1.38\times10^8$ W/cm$^2$. The laser irradiated the capillary at an angle of about 65° with respect to the TOF axis, which was colinear with the long axis of the capillary. The laser operated at a repetition rate of about 200 to about 1000. $CuCl_2$ in the buffer absorbed laser energy, causing continuous vaporization of the eluate into the gas phase. Ions formed at the repeller were immediately extracted into the TOF flight tube.

TOF mass spectrometer. A home-built linear time-of-flight mass spectrometer was used for ion detection. The ion-optics were in the Wiley-McLaren dual-grid configuration (R. M. Jordan Co., Grass Valley, Calif.). The repeller was at 4.1 kV. Two acceleration plates spaced 12 mm apart followed the repeller. The first grid was at 3.9 kV, and the second grid was at ground. A pair of X and Y deflectors were placed behind the acceleration region to adjust the ion trajectories. The flight tube was 1 m long. The pressure of the system is normally at $4\times10^{-7}$ torr, but increases to $6\times10^{-7}$ torr with the introduction of the sample solution. The pressure reading could thus be used as an indication of the stability of the residual flow. Ions were detected by a triple microchannel-plate detector (Galileo, Electro-optics Corp., Sturbridge, Mass.), which provides a gain of about $5\times10^7$.

Data acquisition system. The mass spectrum was recorded by a LeCroy 9410 digital oscilloscope. A data acquisition scheme, based on a General Purpose Interface Bus (GPIB) (National Instruments, Tex.) for data transfer from the LeCroy oscilloscope to a PC computer, was used for recording and storing mass spectra generated by the TOF-MS. To establish the 3D-electropherogram-mass-spectrum, consecutive recording of averaged mass spectra was used. The peaks separated by CE only last several seconds, so the data acquisition system should be fast enough to record the whole spectrum at the laser repetition rate, and to calculate averaged spectra in a time much shorter than the CE event. The greater the frequency of spectrum acquisition, the greater the number available to define the electropherogram profile. The data acquisition and storage processes were controlled by in-house software. Typically, the mass spectrum produced was acquired at a repetition rate of 200 Hz. 100 of these mass spectra were averaged by the digital oscilloscope before being transferred to the computer. Data were averaged and stored to hard disk in the computer at a rate of 1 Hz.

II. Results

LVI-TOF-MS of serotonin. As a control, the mass spectrum of a 0.5 mM $CuCl_2$ solution (FIG. 2(*a*)) showed only low mass peaks (<100 Da), which correspond to $Na^+$ and $K^+$, ions that likely originated from the fused-silica capillary. A small feature corresponding to $Cu^+$ is also seen. Because there is no interference for the mass range larger than 100 Da, and very little between 50 and 100 Da, the buffer system is good not only for large biomolecules but also for small molecules such as amino acids and peptides. These features guided our selection of $CuCl_2$ as the electrolyte, over the many other absorbing buffer solutes that also favor vaporization and ionization.

Figure 2:
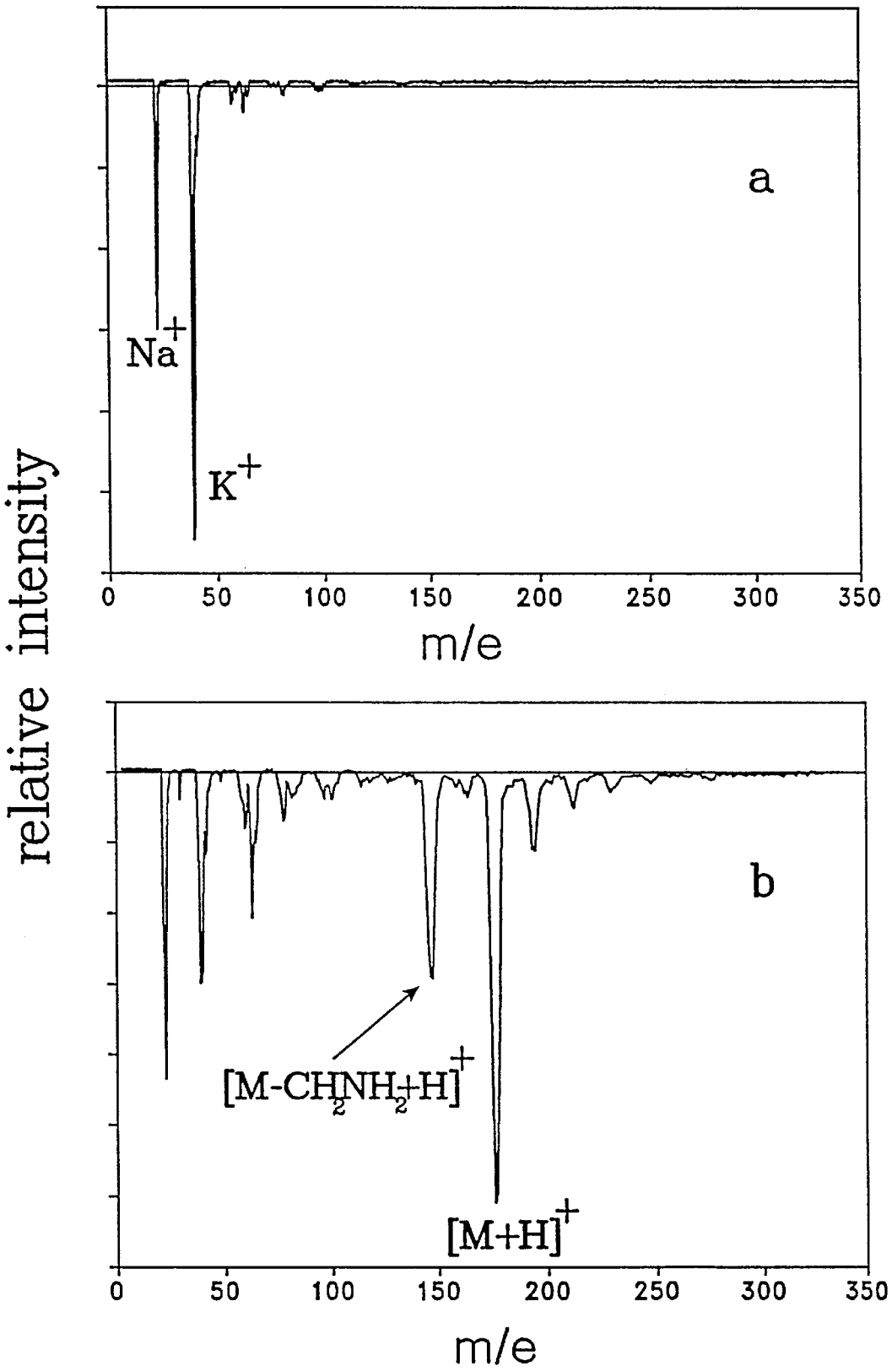
FIG. 2 depicts an LVI-TOF mass spectrum of (a) 0.5 mM $CuCl_2$ solution, and (b) 10 $\mu$m serotonin in 0.5 mM $CuCl_2$ solution.

To demonstrate the performance of continuous-flow laser vaporization/ionization TOF-MS, a continuous stream of analyte solution (10 $\mu$M serotonin in aqueous 0.5 mM $CuCl_2$) was introduced into the system (FIG. 2(*b*)). Both spectra in FIG. 2 were averaged over 100 laser shots at a pulse energy of 34 $\mu$J. Serotonin yields signals for the $[M+H]^+$(M.W.=176) and $[M-CH_2NH_2+H]^+$(M.W.=146) ions. The measured centroid of the parent serotonin peak had a m/z value of 178.3 Da based on quadratic extrapolation ($m/z=at^2+b$) from the $Na^+$ and $K^+$ mass peaks of the spectrum. So, accuracy of the simple mass calibration was satisfactory.

The mass spectrum of serotonin yielded not only intense molecular ions but also fragment ions. The fragmentation pattern of serotonin is similar to that obtained by multiphoton ionization, except that there are fewer fragment peaks in this system. There is a series of adduct peaks to the high-mass side of the parent peak. These correspond to $[M+nH_2O+H]^+$, indicating cluster formation. The adduct peaks are sensitive to laser energy, as would be expected from an explosive vaporization event, possibly with supersonic expansion.

A mass resolution ($t/\Delta t$) of 103 was obtained for the serotonin parent peak. Of the group of catecholamines studied thus far, which includes tryptamine, dopamine, and epinepherin, serotonin gave the highest signal intensity. Thus, a 10-$\mu$M serotonin/$CuCl_2$ solution was selected for use as the standard to optimize subsequent experimental conditions. The ion signal of serotonin was monitored to ensure that conditions are not significantly changed from day to day.

At serotonin concentrations from 5 $\mu$M to 50 $\mu$M, the integrated peak area vs. relative concentration plot was found to be linear. The $R^2$ for the serotonin fragment ion, parent ion and fragment plus parent ion were 0.992, 0.985, and 0.990, respectively. This demonstrates that fragmentation is independent of serotonin concentration.

Figure 3:
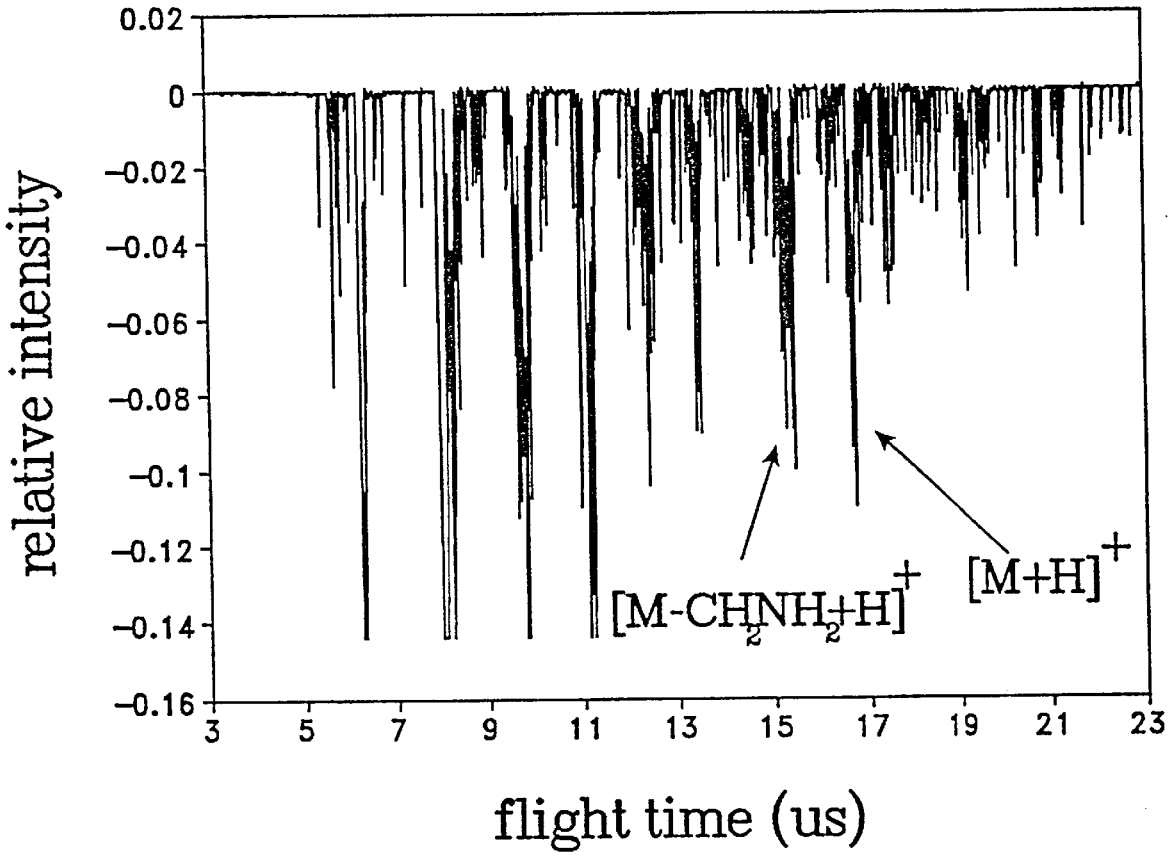
FIG. 3 depicts an LVI-TOF mass spectrum of 1 $\mu$M serotonin obtained from one laser pulse.

In order to optimize the analyte signal, the concentration of $CuCl_2$ was varied from 0 mM to 1 mM. The best serotonin signal was obtained by using 0.05 mM (50 $\mu$M) $CuCl_2$ solution, where the detection limit of the system is 0.2 $\mu$M (S/N=3). The amount of serotonin needed to obtain the single-shot mass spectrum in FIG. 3 was only 8.5 attomole. To test whether ionization efficiency could be enhanced by adding NaCl (to favor the production of $[M+Na]^+$), a solution containing 10 $\mu$M serotonin and 1 mM NaCl in aqueous 0.05 mM $CuCl_2$ was evaluated. The addition of NaCl did not change the serotonin signal intensity.

It should be noted that because serotonin itself strongly absorbs at 248 nm, serotonin ions can be produced upon irradiation even without the addition of $CuCl_2$ to the running buffer. Serotonin can thus be used as the light-absorbing component of the running buffer in place of $CuCl_2$ for CE-MS analysis of larger analytes.

Initially, the ion signal for a steady flow of serotonin solution decreases substantially when high voltage is applied across the capillary. However, this decrease is transient and the signal recovers after about one minute to about two minutes. This response is likely due to the fact that bulk flow generated by the applied field temporarily alters the steady-state condition between the rate of liquid introduction via flow and the rate of vaporization by the laser. Under continuous (hydrodynamic) flow, the ion signal is fairly sensitive to the residual pressure in the sample chamber.

In another experiment, instead of adding serotonin to the running buffer, a 1-$\mu$M aliquot (about 10 nL) of serotonin was injected into the CE-LVI-MS apparatus for about 15 seconds by pressure. The total amount injected was about 31.5 fmol. Since it takes several minutes for the analytes to migrate through the capillary, the momentary disturbance of the vaporization/ionization conditions that accompanies application of high voltage was not a problem. Without applying any voltage, the appearance time for serotonin ions (due to the vacuum-induced residual flow) was 7 to 10 min. The migration time of serotonin was 4.5 min with electrophoresis.

Figure 4:
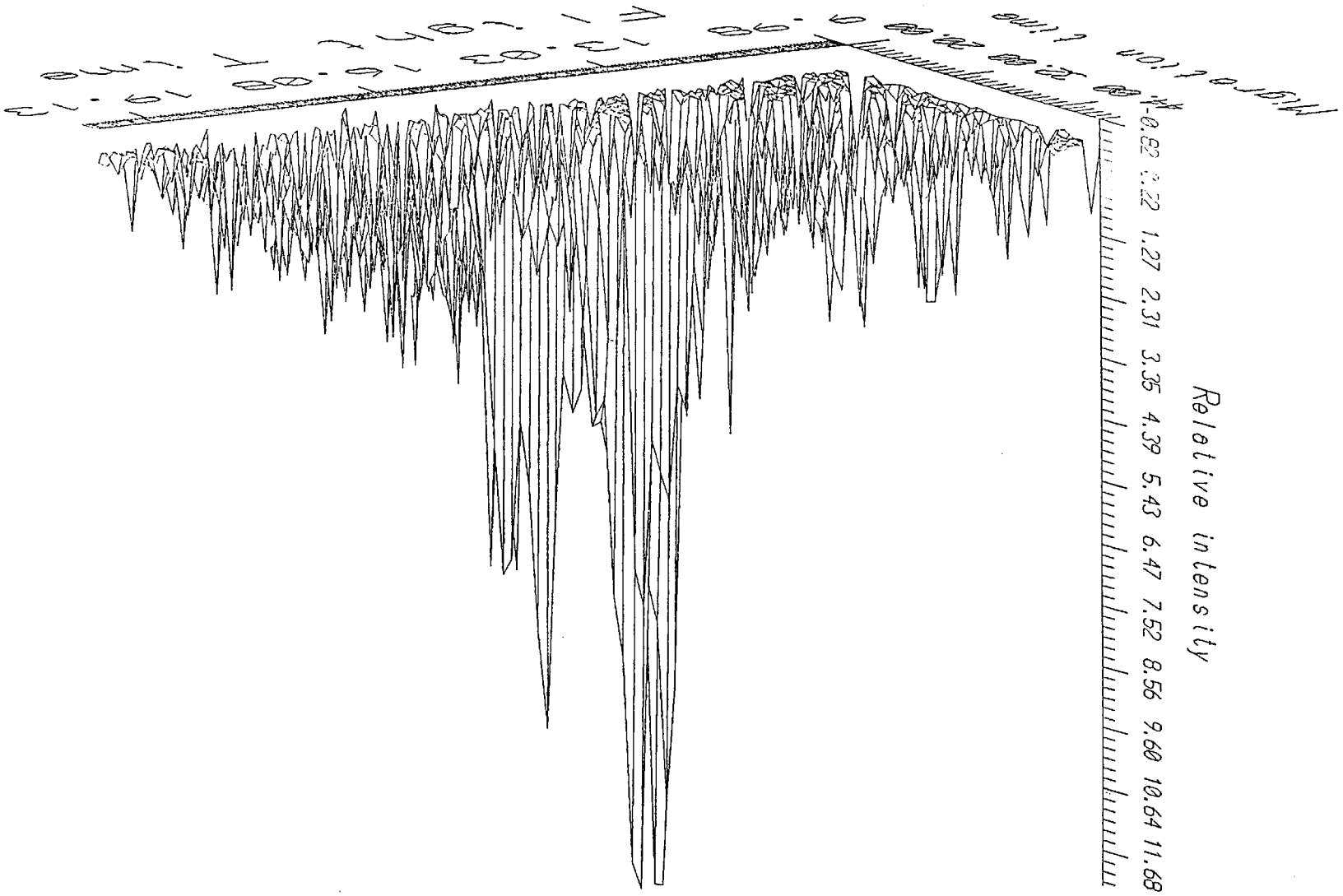
FIG. 4 depicts a 3D-plot of electropherogram-mass spectrum of 1 $\mu$M serotonin.

FIG. 4 shows the 3D electropherogram-mass spectrum produced by electrophoresis of the plug of serotonin. The plot consists of 30 individual mass spectra, with each mass spectrum being an average of 100 laser shots that was saved to the computer continuously. From FIG. 4, the concentration detection limit of the CE-MS is $3\times10^{-7}$M, which corresponds to a mass detection limit of 9 fmol. The peak duration of serotonin was about 15 seconds. Since 200 mass spectra are produced every second, but only half of these are averaged (limited by our oscilloscope), each spectrum in FIG. 4 required only 30 attomoles to produce. Pressure flow due to the vacuum difference did not cause serious peak broadening. If desired, residual pressure flow can be suppressed entirely by evacuating the sample chamber during separation.

In the above experiments, a 75 $\mu$m internal diameter (i.d.) capillary was used. When 10 $\mu$M serotonin (approximately 20 nl) was injected for 5 seconds, the ion peak lasted for 20 seconds. Peak broadening causes dilution of an analyte, so naturally the sensitivity for electrophoresis of an aliquot of serotonin is not as good as that for continuous flow of serotonin in the running buffer. To evaluate the effect of capillary internal diameter, the continuous flow experiment was repeated with a 50 $\mu$m i.d. capillary. For both 50 $\mu$m i.d. and 75 $\mu$m i.d. capillaries, similar signal intensities for continuous introduction of a 10-$\mu$M serotonin solution were obtained. Use of a 50 $\mu$m i.d. capillary is therefore preferable, since a smaller amount of sample is used.

The reproducibility of electrophoresis was examined using a 1-$\mu$M serotonin aliquot in an experiment with 0.05 mM $CuCl_2$ in the running buffer. For 5 consecutive runs involving a 15 second pressure injection of 1 $\mu$M serotonin (approximately 30 nl), the peak intensity variations of m/z=146 and m/z=176 are ±20.4% and ±22.1%, respectively. It was determined that this relatively large variation of the peak intensity was likely due to the sample injection process, not the LVI interface itself; i.e., reproducible injection of analyte under partial vacuum is difficult to implement manually. For example, a solution droplet or a meniscus at the end of the capillary will influence the amount injected.

Next, the quantitative performance of the on-line CE-LVI-MS was evaluated. A series of experiments were done by using a 75 $\mu$m i.d. capillary, 0.5 mM $CuCl_2$ as the electrolyte, and a laser repetition rate of 1000 Hz. For each run, a 3D electropherogram-mass spectrum such as FIG. 4 was obtained and the peak volume of serotonin was calculated. The CE-MS calibration curve of serotonin showed good linearity ($R^2$=0.9819 for fragment ions, 0.9868 for parent ions, 0.9881 for fragment+parent ions) in the concentration range from 5 $\mu$M to 50 $\mu$M.

Figure 5:
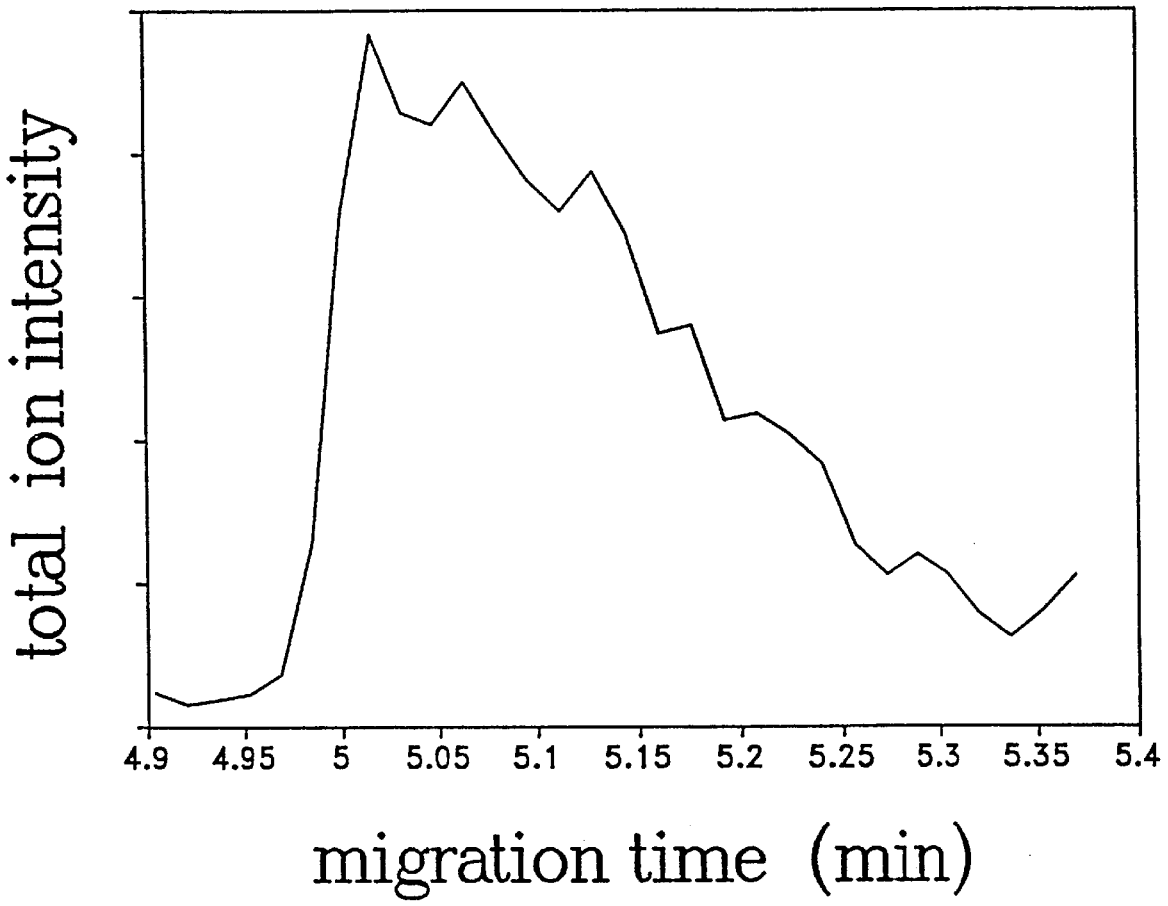
FIG. 5 depicts a total-ion electropherogram of a two-component mixture containing 10 $\mu$M serotonin and 20 $\mu$M tryptamine.
Figure 6:
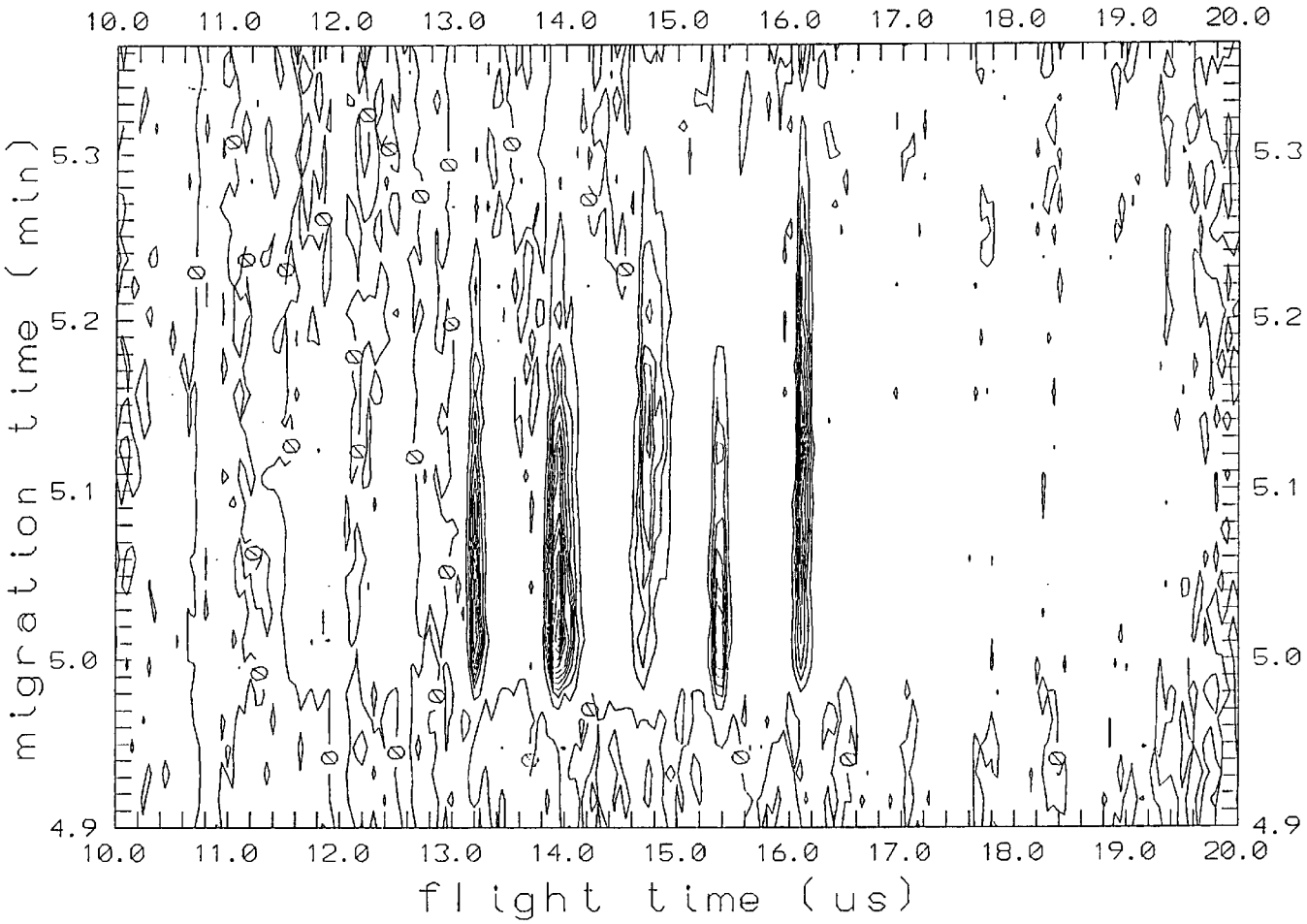
FIG. 6 depicts a contour plot of electropherogram-mass spectrum of the data from FIG. 5. From right to left: (1) serotonin parent peak; (2) tryptamine parent peak; (3) serotonin fragment peak; (4) and (5) tryptamine fragment peaks.

A two-component mixture of 10 $\mu$M serotonin and 20 $\mu$M tryptamine (approximately 10 nl) was injected into the capillary by pressure for 5 seconds. FIG. 5 shows the total-ion electropherogram. Under standard separation conditions, the two components cannot be resolved completely by CE. However, in CE-LVI-MS, those two components were easily distinguished by their mass difference. FIG. 6 shows the contour plot derived from 30 consecutive mass spectra obtained during CE separation. The peaks represented $[\text{serotonin}+H]^+$ (m/z=176), $[\text{serotonin}-CH_2NH_2+H]^+$ (m/z=146), $[\text{tryptamine}+H]^+$ (m/z=161), $[\text{tryptamine}-CH_2NH_2+H]^+$ (m/z=131), and an unidentified fragment peak from tryptamine at m/z=118. The peak centroids for serotonin and tryptamine in the electropherogram were 5.14 min and 5.05 min, respectively.

Figure 7:
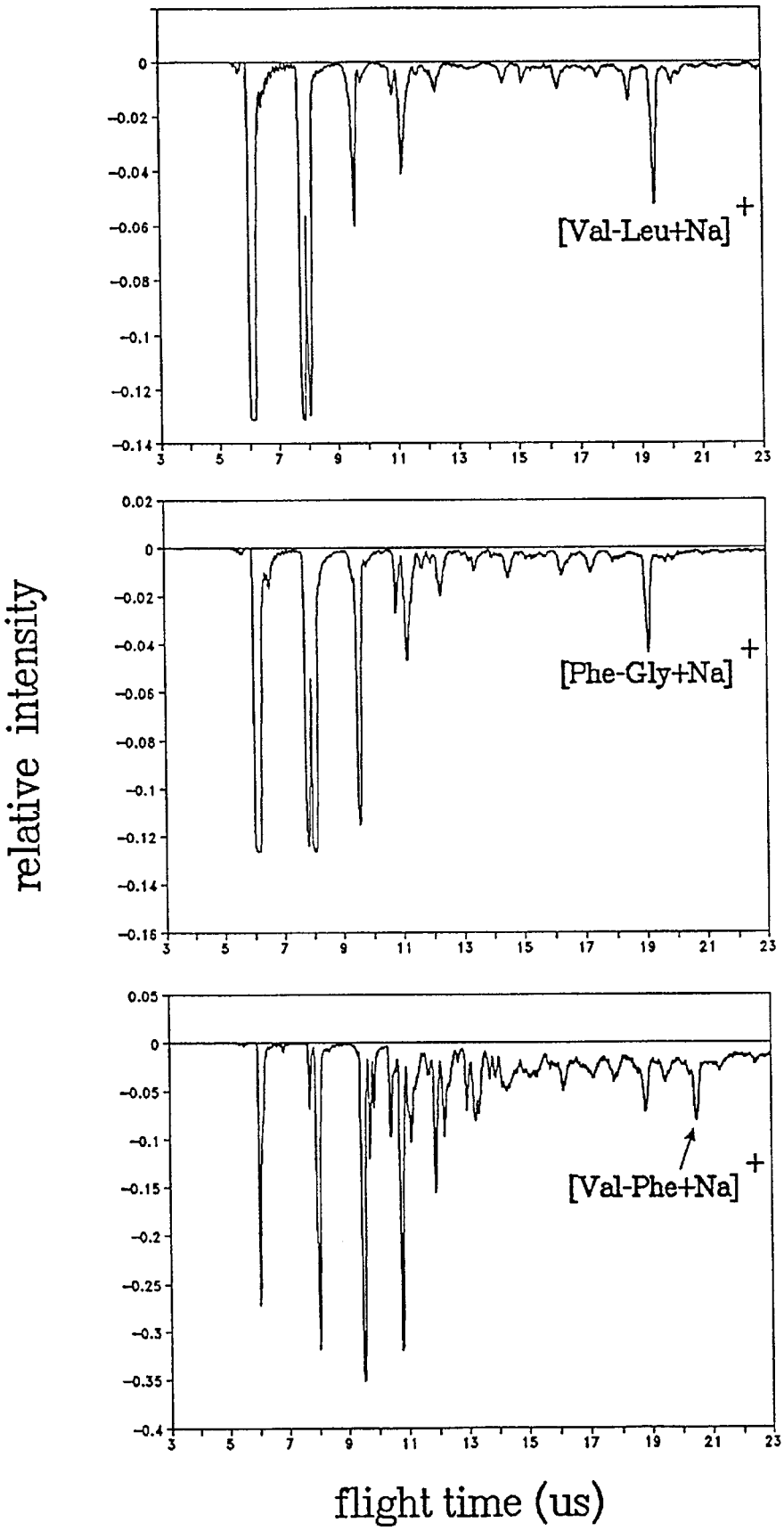
FIG. 7 depicts an LVI-TOF mass spectrum of 50 $\mu$M solutions of (a) Val-Leu (M.W.=230); (b) Phy-Gly (M.W.=222); and (3) Val-Phe (M.W.=264).

LVI-TOF-MS of dipeptides. The laser vaporization/ionization interface used in this example makes use of $CuCl_2$ to absorb laser energy. To investigate whether laser absorption by the analyte itself is necessary for analyte ion formation, three different dipeptides were studied: Val-Leu (m/z=230, non-absorbing), Phe-Gly (m/z=222, absorbing) and Val-Phe (m/z=264, absorbing). FIG. 7 shows the laser vaporization/ionization mass spectra of these three compounds obtained by continuously flowing 50 $\mu$M of each in 0.05 mM $CuCl_2$ solution at a flow rate of 2.5 nl/s. In each spectrum, an intense $[M+Na]^+$ ion peak along with some fragment ion peaks are obtained. Detection of the parent ion from Val-Leu, which does not absorb at 248 nm, indicates that laser absorption by the analyte itself is not required for analyte ion formation. Further, these results confirm that the LVI interface of the present invention is expected useful in protein sequencing and other important biological and chemical applications that require structural analysis of non-absorbing compounds.

Figure 8:
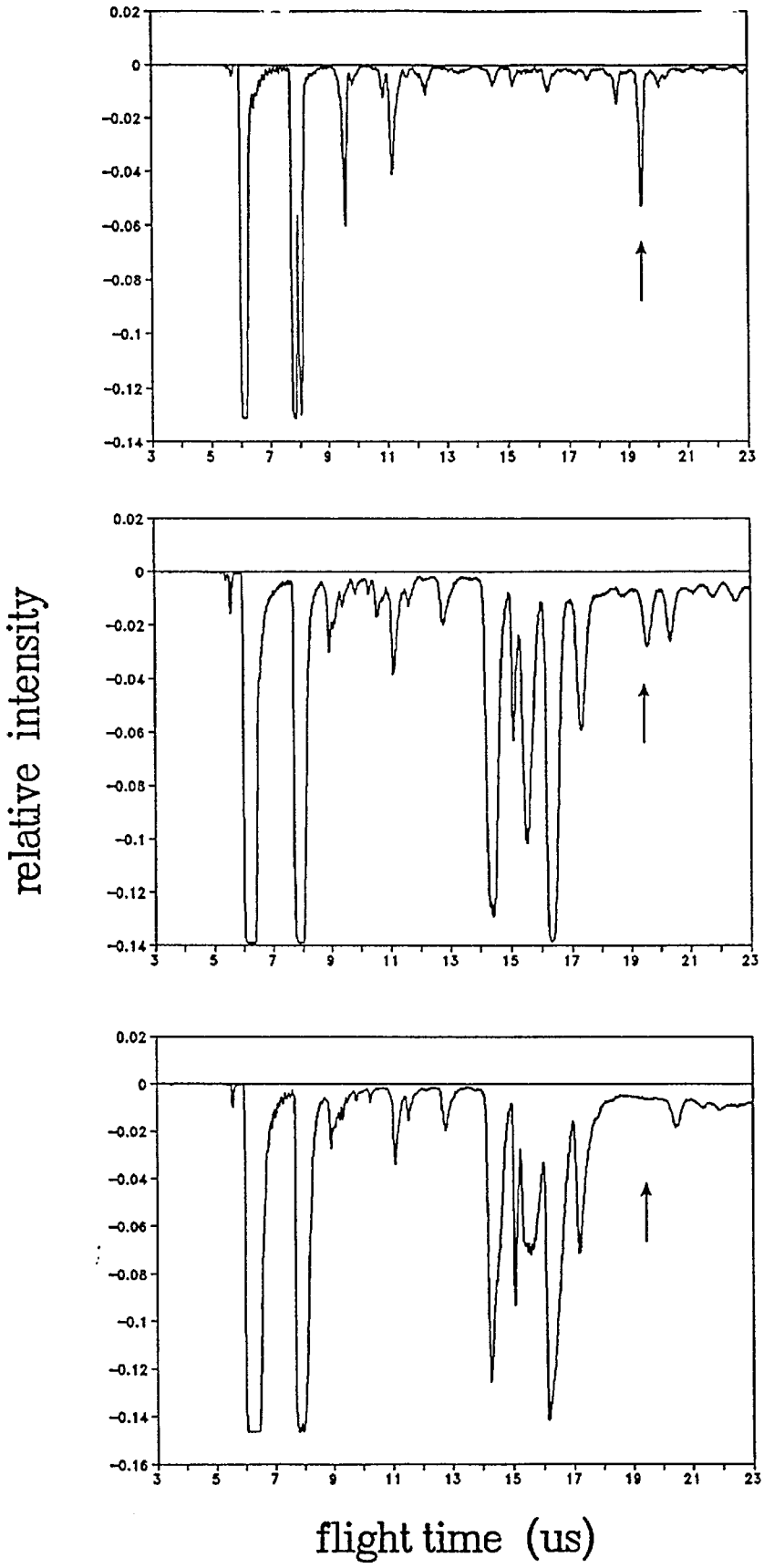
FIG. 8 depicts an LVI-TOF mass spectrum of (a) 50 $\mu$M Val-Leu; (b) 50 $\mu$M Val-Leu plus 20 mM 2,5-dihydroxybenzoic acid; and (c) 20 mM 2,5-dihydroxybenzoic acid. The arrow indicates the location of the ion $[\text{Val-Leu+Na}]^+$.

Finally, to investigate whether the addition of a typical MALDI matrix to the CE buffer would be beneficial, two MALDI matrices were evaluated: nicotinic acid and 2,5-dihydroxybenzoic acid. These two compounds are known to be sources of $H^+$ ions and were thus expected to enhance the ionization efficiency of the LVI-MS interface. On adding 1 mM nicotinic acid to the sample solution, the intensity of the serotonin analyte parent peak actually decreased by about 75%. A smaller decrease (50%) was found for the fragment peak. Although the background ions from 20 mM of nicotinic acid overlapped the serotonin signal, it was nonetheless evident that the serotonin peak was substantially suppressed. FIG. 8 shows that adding 20 mM 2,5-dihydroxybenzoic acid also decreased the serotonin signal. In solid MALDI, it is generally accepted that the MALDI matrix absorbs laser light to initiate vaporization, and then transfers a cation ($H^+$, $Na^+$, $K^+$) to the analyte. Suprisingly, however, in the LVI interface, the addition of a MALDI matrix did not enhance the ionization efficiency. In fact, it appeared instead to compete for ion formation.

The complete disclosure of all patents, patent documents, and publications cited herein are incorporated by reference. The foregoing detailed description and examples have been given for clarity of understanding only. No unnecessary limitations are to be understood therefrom. The invention is not limited to the exact details shown and described, for variations obvious to one skilled in the art will be included within the invention defined by the claims.

What is claimed is:

1. A system for coupling a microscale analyte separation apparatus to a mass spectrometer comprising:

a mass spectrometer comprising an evacuated internal chamber;

a capillary comprising an outlet end for delivery of a liquid comprising a separated analyte to the mass spectrometer, wherein the outlet end is located in the evacuated internal chamber of the mass spectrometer; and an electrical conductor electrically connected to the outlet end of the capillary, at least a portion of the electrical conductor being located in the evacuated internal chamber of the mass spectrometer.

2. The system of claim 1 wherein the mass spectrometer further comprises a transparent window to permit irradiation of the outlet end of the capillary from a location external to the mass spectrometer.

3. The system of claim 1 wherein the mass spectrometer further comprises a wall, and wherein the capillary further comprises a capillary segment penetrating said wall.

4. The system of claim 3 wherein the capillary segment is physically stabilized by an encasement.

5. The system of claim 1 wherein the liquid further comprises a light-absorbing water-soluble solute.

6. The system of claim 1 further comprising a laser to irradiate the outlet end of the capillary.

7. The system of claim 6 wherein the laser is a pulsed laser.

8. The system of claim 6 wherein the laser is positioned to direct a beam of light such that the focal point of the beam is coincident with the outlet end of the capillary.

9. The system of claim 6 wherein light from the laser is transmitted to the outlet end of the capillary using at least one optical fiber.

10. The system of claim 6 wherein the mass spectrometer further comprises a transparent window, and wherein laser is located external to the mass spectrometer and is positioned to direct a beam of light through the transparent window to irradiate the outlet end of the capillary.

11. The system of claim 6 wherein the liquid further comprises a light-absorbing water-soluble solute that absorbs light having a selected wavelength, and wherein the laser emits light having a wavelength about equal to the selected wavelength.

12. The system of claim 1 wherein the electrical conductor comprises a metal wire.

13. The system of claim 12 wherein the metal wire comprises at least one metal selected from the group consisting of gold, platinum and tungsten.

14. The system of claim 13 wherein the metal wire comprises tungsten.

15. The system of claim 1 wherein the electrical conductor comprises a salt bridge passing through the wall of the mass spectrometer.

16. The system of claim 1 wherein the electrical conductor comprises a liquid junction comprising a salt solution.

17. The system of claim 1 wherein the capillary further comprises an inlet end, and wherein the interface further comprises an evacuated sample chamber comprising the inlet end of the capillary for introducing a sample comprising the analyte into the inlet end of the capillary.

18. The system of claim 1 wherein the mass spectrometer is a time-of-flight mass spectrometer (TOF-MS).

19. A device for coupling a microscale analyte separation apparatus to a mass spectrometer, comprising a capillary comprising an outlet end for delivery of a liquid comprising an analyte to the mass spectrometer, wherein the mass spectrometer comprises an evacuated internal chamber, and wherein the outlet end of the capillary is located in the evacuated internal chamber of the mass spectrometer, the outlet end of the capillary being electrically connected to an electrical conductor at least a portion of which is located in the evacuated internal chamber of the mass spectrometer.

20. The device of claim 19 wherein the capillary further comprises an inlet end located in an evacuated sample chamber for introducing a sample comprising the analyte into the capillary.

21. The device of claim 19 wherein the liquid further comprises a light-absorbing water-soluble solute.

22. An analyte separation and detection system comprising:

a mass spectrometer comprising an evacuated internal chamber;

a microscale analyte separation apparatus comprising a capillary comprising an outlet end for delivery of a liquid comprising a separated analyte to the mass spectrometer, wherein the outlet end is located in the evacuated internal chamber of the mass spectrometer; and an electrical conductor electrically connected to the outlet end of the capillar, at least a portion of the electrical conductor being located in the evacuated internal chamber of the mass spectrometer.

23. The analyte separation and detection system of claim 22 wherein the microscale analyte separation apparatus is selected from the group consisting a capillary electrophoresis (CE) apparatus, a fast CE apparatus and a capillary electrochromatography (CEC) apparatus.

24. The analyte separation and detection system of claim 22 further comprising an evacuated sample chamber; and wherein the capillary further comprises an inlet end for introducing a sample comprising the analyte into the capillary, the inlet end of the capillary being located in the evacuated sample chamber.

25. A device for analyzing an analyte comprising:

a mass spectrometer comprising an evacuated internal chamber;

a capillary comprising an outlet end for delivery of a liquid comprising the analyte to the mass spectrometer, wherein the outlet end is located in the evacuated internal chamber of the mass spectrometer; and an electrical conductor electrically connected to the outlet end of the capillar, at least a portion of the electrical conductor being located in the evacuated internal chamber of the mass spectrometer.

26. The device of claim 25 wherein the liquid further comprises a light-absorbing solute.

27. The device of claim 25 further comprising a laser positioned to direct a beam of light such that the focal point of the beam is coincident with the outlet end of the capillary.

28. A method for structural characterization of an analyte comprising:

(a) introducing a liquid comprising an analyte and a light-absorbing water-soluble solute at a concentration of less than 1.0 mM into the evacuated internal chamber of a mass spectrometer;

(b) irradiating the liquid to cause vaporization and ionization of the analyte; and (c) analyzing the vaporized ionized analyte using mass spectrometry.

29. The method of claim 28 wherein the liquid is water.

30. The method of claim 28 performed in the absence of a make-up solvent.

31. The method of claim 28 wherein step (a) comprises eluting the liquid from the outlet end of a capillary, wherein the outlet end of the capillary is located inside the evacuated internal chamber of the mass spectrometer.

32. The method of claim 28 wherein the light-absorbing solute absorbs light having a selected wavelength, and wherein step (b) further comprises irradiating the liquid with a laser that emits light having a wavelength about equal to the selected wavelength.

33. The method of claim 32 wherein the laser is located external to the mass spectrometer and is positioned to direct a beam of light such that the focal point of the beam is coincident with the outlet end of the capillary.

34. The method of claim 32 wherein step (b) further comprises using optical fibers to transmit the laser light to the liquid.

35. The method of claim 28 wherein the light-absorbing water-soluble solute comprises at least one solute selected from the group consisting of a rare earth ion, an organic solute comprising a benzene ring, copper (II) chloride, serotonin and aniline.

36. The method of claim 35 wherein the light-absorbing water-soluble solute comprises copper (II) chloride.

37. The method of claim 28 wherein the analyte concentration detection limit is less than about $10^{-6}$M.

38. A method for structural characterization of a separated analyte comprising:

(a) introducing a sample comprising at least one analyte into a separation capillary containing a liquid buffer or solvent, wherein at least one of the sample and the liquid buffer or solvent comprises a light-absorbing water-soluble solute at a concentration of less than about 1.0 mM;

(b) separating the at least one analyte from the sample to yield an eluate comprising the separated analyte and the light-absorbing solute;

(c) eluting the eluate from the outlet end of a capillary, wherein the outlet end is located in the evacuated internal chamber of a mass spectrometer;

(d) irradiating the eluate with a laser during elution from the outlet end of the capillary to cause vaporization and ionization of the separated analyte; and (e) analyzing the vaporized ionized separated analyte using mass spectrometry.

39. The method of claim 38 wherein the light-absorbing water-soluble solute absorbs light having a selected wavelength, and wherein the laser emits light having a wavelength about equal to the selected wavelength.

40. The method of step 38 wherein step (b) comprises chromatographically separating the at least one analyte from the sample.

41. The method of claim 38 wherein step (b) comprises electrophoretically separating the at least one analyte from the sample.

42. The method of claim 41 wherein an electrically conductive buffer comprising the light-absorbing water-soluble solute is used to effect the electrophoretic separation.

43. The method of claim 42 wherein the light-absorbing water-soluble solute is an electrolyte.

44. The method of claim 42 wherein the electrically conductive buffer comprises about 0.0–1.0 mM $CuCl_2$ in water.

45. The method of claim 38 wherein the mass spectrometer of step (c) is a time-of-flight mass spectrometer.

46. The method of claim 38 performed in the absence of a makeup solvent.

47. The method of claim 38 wherein the light-absorbing water-soluble solute comprises at least one solute selected from the group consisting of a rare earth ion, an organic solute comprising a benzene ring, copper (II) chloride, serotonin and aniline.

48. The method of claim 47 wherein the light-absorbing water-soluble solute comprises copper (II) chloride.

49. The method of claim 38 wherein the analyte concentration detection limit is less than about $10^{-6}$M.

50. A method for structural characterization of a separated analyte comprising:

(a) introducing a sample comprising at least one analyte into the inlet end of a capillary;

(b) separating the at least one analyte from the sample using a flow of aqueous running buffer comprising a light-absorbing water-soluble solute at a concentration of less than about 1.0 mM, to yield an eluate comprising the separated analyte and a light-absorbing solute;

(c) eluting the eluate from the outlet end of the capillary, wherein the outlet end of the capillary is located in the evacuated internal chamber of a mass spectrometer;

(d) irradiating the eluate with a pulsed laser during elution from the outlet end of the capillary in the absence of a makeup solvent to cause vaporization and ionization of the separated analyte; and (e) analyzing the vaporized ionized separated analyte using mass spectrometry.

51. The method of claim 50 wherein step (b) comprises electrophoretically separating the at least one analyte from the sample.

52. The method of claim 50 further comprising, prior to step (d), determining an optimal solution flow rate for the aqueous running buffer such that a continuous flow of the aqueous running buffer at said optimal flow rate during step (d) prevents ice from forming at the outlet end of the capillary, and wherein said method further comprises continuously flowing the aqueous running buffer through the capillary during step (d) at said optimal flow rate.

53. The method of claim 52 wherein determining the optimal solution flow rate for the aqueous running buffer comprises evaluating the rate of vaporization at the outlet end of the capillary in step (d).

54. The method of claim 50 wherein the light-absorbing water-soluble solute comprises at least one solute selected from the group consisting of a rare earth ion, an organic solute comprising a benzene ring, copper (II) chloride, serotonin and aniline.

55. The method of claim 54 wherein the light-absorbing water-soluble solute comprises copper (II) chloride.

56. The method of claim 50 wherein the analyte concentration detection limit is less than about $10^{-6}$M.

57. An analyte separation and detection system comprising:

a mass spectrometer comprising an evacuated internal chamber;

an evacuated sample chamber; and a separation capillary comprising an inlet end for introduction of a liquid sample comprising an analyte into the separation capillary, the inlet end being located in the evacuated sample chamber; and an outlet end for delivery of the separated analyte to the mass spectrometer, the outlet end being located in the evacuated internal chamber of the mass spectrometer.

58. The system of claim 57 wherein the evacuated sample chamber is evacuated to a pressure of about 50 torr to about 100 torr.

59. A device for analyzing an analyte comprising:

a mass spectrometer comprising an evacuated internal chamber;

an evacuated sample chamber; and a capillary comprising an inlet end for introduction of a liquid sample comprising an analyte into the capillary, the inlet end being located in the evacuated sample chamber; and an outlet end for delivery of the analyte to the mass spectrometer, the outlet end being located in the evacuated internal chamber of the mass spectrometer.

60. The device of claim 59 wherein the evacuated sample chamber is evacuated to a pressure of about 50 torr to about 100 torr.

61. A system for coupling a microscale analyte separation apparatus to a mass spectrometer comprising:

a mass spectrometer comprising an evacuated internal chamber; and a capillary comprising an outlet end for delivery of a liquid comprising a separated analyte and a light-absorbing water-soluble solute to the mass spectrometer, wherein the outlet end is located in the evacuated internal chamber of the mass spectrometer, and wherein light-absorbing water-soluble solute is not capable of transferring a cation to the analyte upon irradiation.

62. The system of claim 61 further comprising a laser for irradiating the liquid at the outlet end of the capillary.

63. A device for coupling a microscale analyte separation apparatus to a mass spectrometer, comprising a capillary comprising an outlet end for delivery of a liquid comprising an analyte and a light-absorbing water-soluble solute to the mass spectrometer, wherein the mass spectrometer comprises an evacuated internal chamber and the outlet end of the capillary is located in the evacuated internal chamber of the mass spectrometer, and wherein light-absorbing water-soluble solute is not capable of transferring a cation to the analyte upon irradiation.

64. The device of claim 63 further comprising a laser for irradiating the liquid at the outlet end of the capillary.

65. An analyte separation and detection system comprising:

a mass spectrometer comprising an evacuated internal chamber; and a microscale analyte separation apparatus comprising a capillary comprising an outlet end for delivery of a liquid comprising a separated analyte and a light-absorbing water-soluble solute to the mass spectrometer, wherein the outlet end is located in the evacuated internal chamber of the mass spectrometer and wherein light-absorbing water-soluble solute is not capable of transferring a cation to the analyte upon irradiation.

66. The device of claim 65 further comprising a laser for irradiating the liquid at the outlet end of the capillary.

67. A device for analyzing an analyte comprising:

a mass spectrometer comprising an evacuated internal chamber; and a capillary comprising an outlet end for delivery of a liquid comprising the analyte to the mass spectrometer, wherein the outlet end is located in the evacuated internal chamber of the mass spectrometer and wherein the light-absorbing water-soluble solute is not capable of transferring a cation to the analyte upon irradiation.

68. The device of claim 67 further comprising a laser for irradiating the liquid at the outlet end of the capillary.

69. A method for structural characterization of an analyte comprising:

(a) introducing a liquid comprising an analyte and a light-absorbing water-soluble solute into the evacuated internal chamber of a mass spectrometer;

(b) irradiating the liquid to cause vaporization and ionization of the analyte without the transfer of a cation from the light-absorbing water-soluble solute to the analyte; and (c) analyzing the vaporized ionized analyte using mass spectrometry.

70. The method of claim 69 wherein the light-absorbing water-soluble solute absorbs light having a selected wavelength, and wherein the laser emits light having a wavelength about equal to the selected wavelength.

71. The method of claim 69 wherein the light-absorbing water-soluble solute comprises at least one solute selected from the group consisting of a rare earth ion, an organic solute comprising a benzene ring, copper (II) chloride, serotonin and aniline.

72. The method of claim 71 wherein the light-absorbing water-soluble solute comprises copper (II) chloride.

73. A method for structural characterization of a separated analyte comprising:

(a) introducing a sample comprising at least one analyte into a separation capillary containing a liquid buffer or solvent, wherein at least one of the sample and the liquid buffer or solvent comprises a light-absorbing water-soluble solute;

(b) separating the at least one analyte from the sample to yield an eluate comprising the separated analyte and the light-absorbing solute;

(c) eluting the eluate from the outlet end of a capillary, wherein the outlet end is located in the evacuated internal chamber of a mass spectrometer;

(d) irradiating the eluate with a laser during elution from the outlet end of the capillary to cause vaporization and ionization of the separated analyte without the transfer of a cation from the light-absorbing water-soluble solute to the analyte; and (e) analyzing the vaporized ionized separated analyte using mass spectrometry.

74. The method of claim 73 wherein the light-absorbing water-soluble solute absorbs light having a selected wavelength, and wherein the laser emits light having a wavelength about equal to the selected wavelength.

75. The method of claim 73 wherein the light-absorbing water-soluble solute comprises at least one solute selected from the group consisting of a rare earth ion, an organic solute comprising a benzene ring, copper (II) chloride, serotonin and aniline.

76. The method of claim 75 wherein the light-absorbing water-soluble solute comprises copper (II) chloride.

* * * * *